US005997329A

United States Patent [19]

Kosmala

[11] Patent Number: 5,997,329

[45] Date of Patent: Dec. 7, 1999

[54] ENHANCED CONNECTOR SYSTEM

[75] Inventor: Michael Lawrence Kosmala, Aliso Viejo, Calif.

[73] Assignee: ITT Manufacturing Enterprises, Inc., Wilmington, Del.

[21] Appl. No.: 08/991,108

[22] Filed: Dec. 16, 1997

[51] Int. Cl.[6] ..... H01R 13/62

[52] U.S. Cl. ..... 439/260; 439/329

[58] Field of Search ..... 439/260, 329, 439/353, 354, 357, 358, 79, 259

[56] References Cited

U.S. PATENT DOCUMENTS 5,569,047 10/1996 Pauza et al. ..... 439/353

5,580,261 12/1996 Meynier ..... 439/188

*Primary Examiner*—Steven L. Stephan

*Assistant Examiner*—Eugene G. Byrd

*Attorney, Agent, or Firm*—Thomas L. Peterson

[57] ABSTRACT

A connector system includes a receptacle housing (30) with a cam wall (32) lying over a row of traces (16) on a circuit board, and a plug connector (22) with plug contacts (20) that are downwardly deflected by the cam wall against the traces as the connectors mate, which is especially compact and which provides extra protection against damage to the plug contacts. The cam wall projects rearwardly from a front wall (50) of the receptacle housing, with the rear portion of the cam wall free of connection to the rest of the housing, so it can enter an opening (110) at the front end of the plug connector. This results the cam wall providing side spaces (64, 66) and areas therebelow where aligner slots (80, 82) are located for receiving aligners and where latches (90, 92) can enter to engage strikes (94, 96). Also, this enables the plug connector housing to have a top wall (122) that lies over the plug contacts to protect them. The rear portions of the contacts are divided into two groups, with a first group (150) extending more rearwardly and lying in rear groove portions (160), and with the second group lying on raised platforms (162) and separated by bars (170) of a top wall member (124).

19 Claims, 7 Drawing Sheets

10
12
14
16
20
22
24
26
28
29
30
32
34
36
38
39
40
42
50
52
54
60
62
64
66
67
68
70
72
74
76
78
80
82
90
92
94
96
100
102
104
110
120
122
124
130
132
134
136
138
140
142
180
182
204
206
C
U
R
D
F
L

FIG. 4
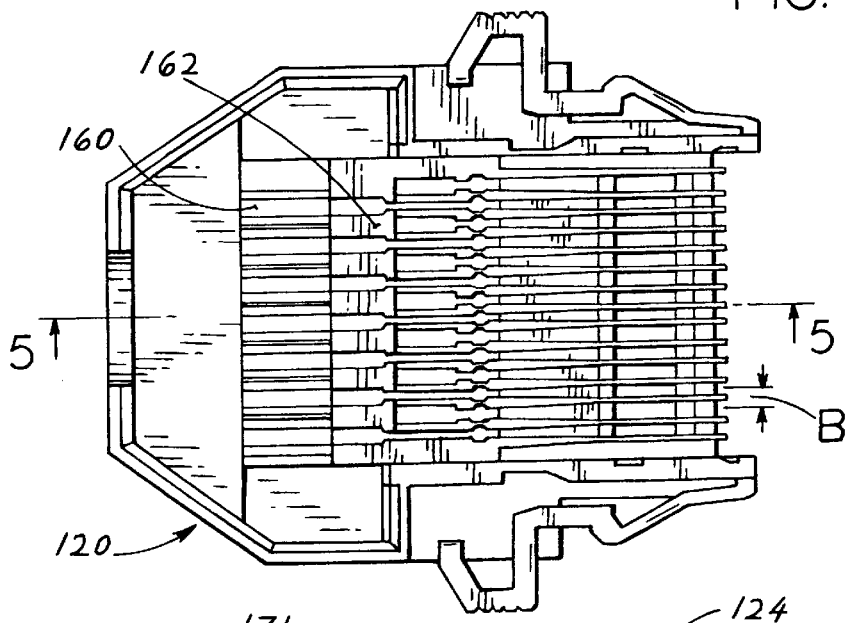
FIG. 5
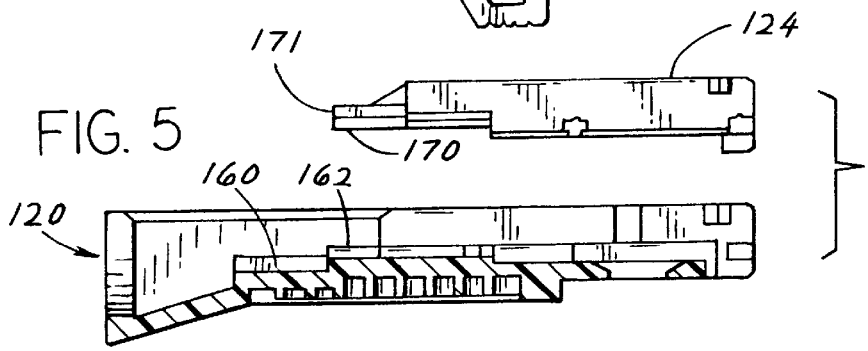
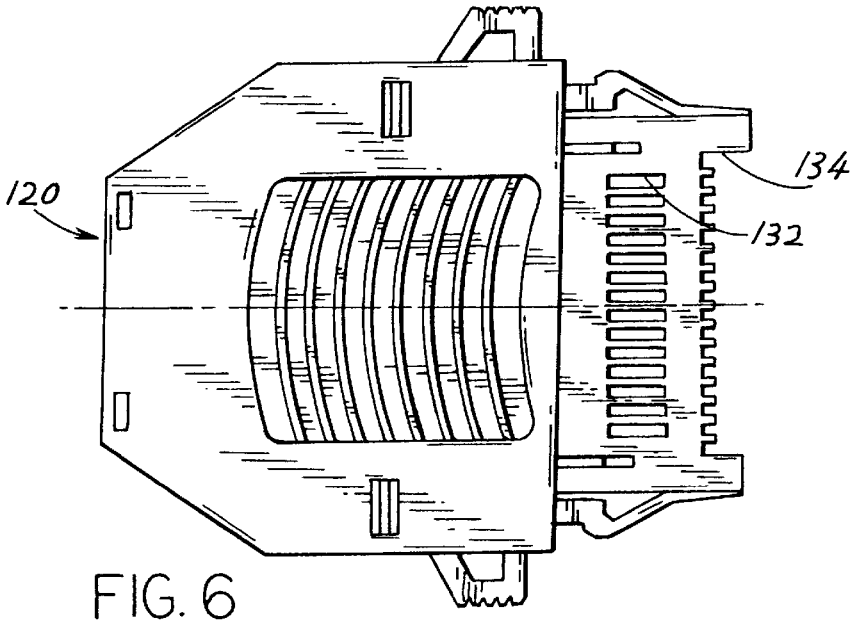
FIG. 6

FIG. 10
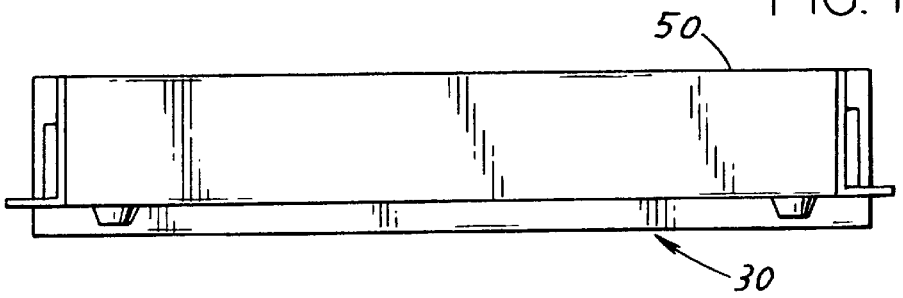
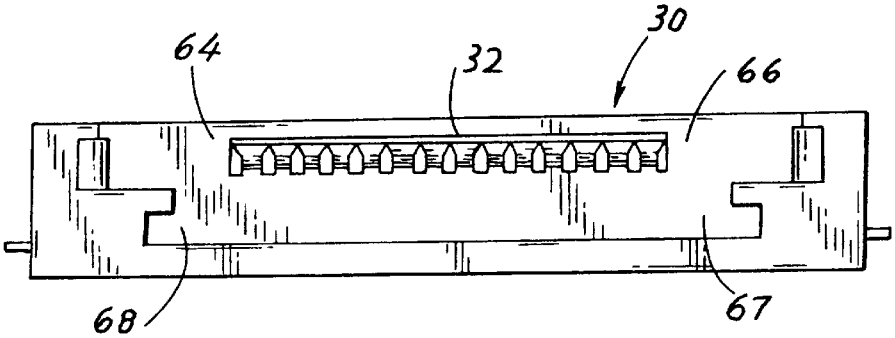
FIG. 11
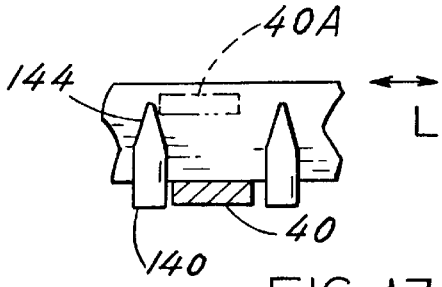
FIG. 13
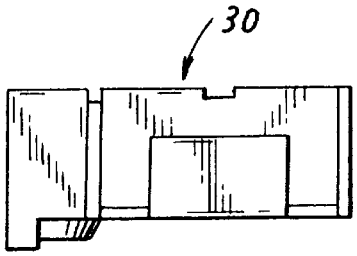
FIG. 12
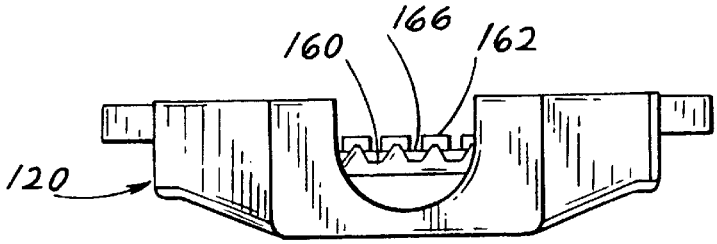
FIG. 14

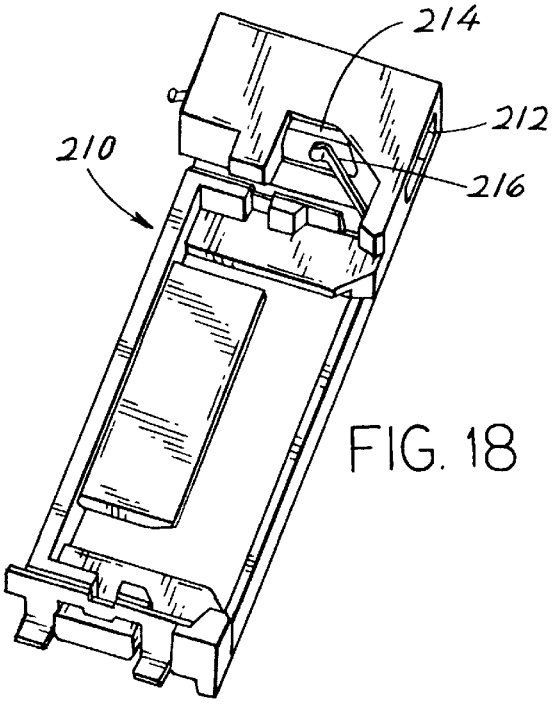
FIG. 18
FIG. 19
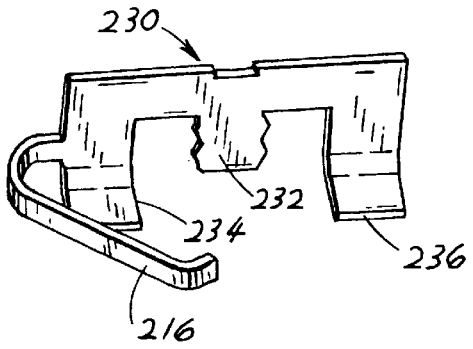
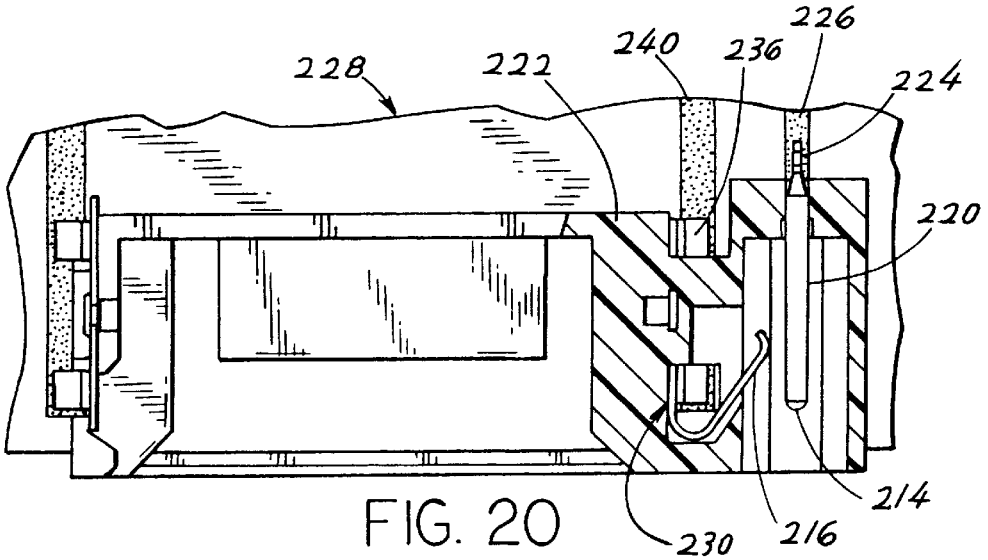
FIG. 20
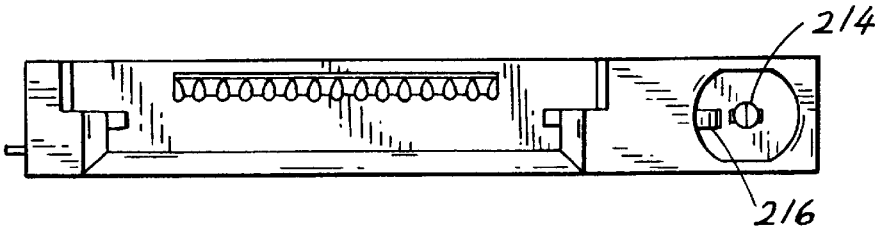
FIG. 21

ENHANCED CONNECTOR SYSTEM

BACKGROUND OF THE INVENTION

Presently, portable cellular telephones are provided with small openings, each leading to a receptacle connector with contacts having tails that are soldered to traces on a circuit board. As the telephones become smaller and less space is available, it is found difficult to precisely locate the receptacle contacts. One solution that the present assignee has developed is the provision of a row of traces on the circuit board. The receptacle housing has a top wall extending between housing side walls. The plug connector has a plurality of parallel separators with contacts lying between them, and the receptacle top wall has ribs that enter the spaces between the separators to downwardly depress the contacts against the traces. If the small volume available could be even more efficiently used, as to hold aligners and latches, and if the plug contacts could be better protected, this would result in a miniature connector system of even greater utility.

SUMMARY OF THE INVENTION

In accordance with one embodiment of the present invention, a connector system is provided that includes plug and receptacle connectors, where the connectors are constructed to optimally use the available space and provide good protection for the plug contacts. The receptacle connector includes a receptacle housing that mounts on a circuit board, the housing having a cam wall that lies over a laterally-extending row of traces on the board. The plug has a row of contacts with front portions having cam-follower locations that are downwardly depressed by an inclined surface of the cam wall as the connectors mate, to cause trace-engaging locations on the contacts to engage the traces. Instead of using a cam wall that extends between opposite sides of the receptacle housing, a cam wall is provided with a free rear portion, that includes the inclined surface, so the cam wall can project into an opening in the plug housing. This has the advantage of leaving spaces on laterally opposite sides of the cam wall, where latches and aligners can lie. Also, this enables the plug housing to have a top wall that protects the contacts.

The plug housing includes a bottom wall front portion that lies under the contacts and that has only a limited area through which the trace-engaging locations of the contacts can project, to engage the traces. The contacts have rear ends, with one group of contacts extending rearward of the other contacts and with the rear ends of the first group lying in slots at the rear of the plug housing bottom wall. The second group of contacts lie on platforms and lie forward and above the rear ends of the first group of contacts. The plug housing has a top wall front portion with bars that lie in grooves formed between the platforms. This provides ready access for soldering the front ends of wires to the different contacts.

The novel features of the invention are set forth with particularity in the appended claims. The invention will be best understood from the following description when read in conjunction with the accompanying drawings.

BRIEF DESCRIPTION OF THE DRAWINGS

FIG. 4 is a plan view of the bottom wall member of the connector of FIG. 3.

FIG. 5 is an exploded view, showing the bottom wall member taken on line 5—5 of FIG. 4, and also including a side elevation view of the top wall member.

FIG. 6 is a bottom view of the bottom wall member of FIG. 4.

FIG. 10 is a rear elevation view of the receptacle connector housing of FIG. 7.

FIG. 11 is a front elevation view of the receptacle connector housing of FIG. 7.

FIG. 12 is a side elevation view of the receptacle connector housing of FIG. 7.

FIG. 13 is an enlarged view of a portion of FIG. 11, and also showing, in phantom lines, a misaligned contact, and showing the contact in sectional lines in a fully installed position.

FIG. 14 is a rear elevation view of the bottom wall member of FIG. 6.

FIG. 18 is an isometric view of a receptacle connector of another embodiment of the invention, which includes a jack socket.

FIG. 19 is an isometric view of a clip of the connector of FIG. 18.

FIG. 20 is a plan view of the connector of FIG. 18, showing it mounted on a circuit board.

FIG. 21 is a front elevation view of the connector of FIG. 18.

DESCRIPTION OF THE PREFERRED EMBODIMENTS

Figures 1, 2:
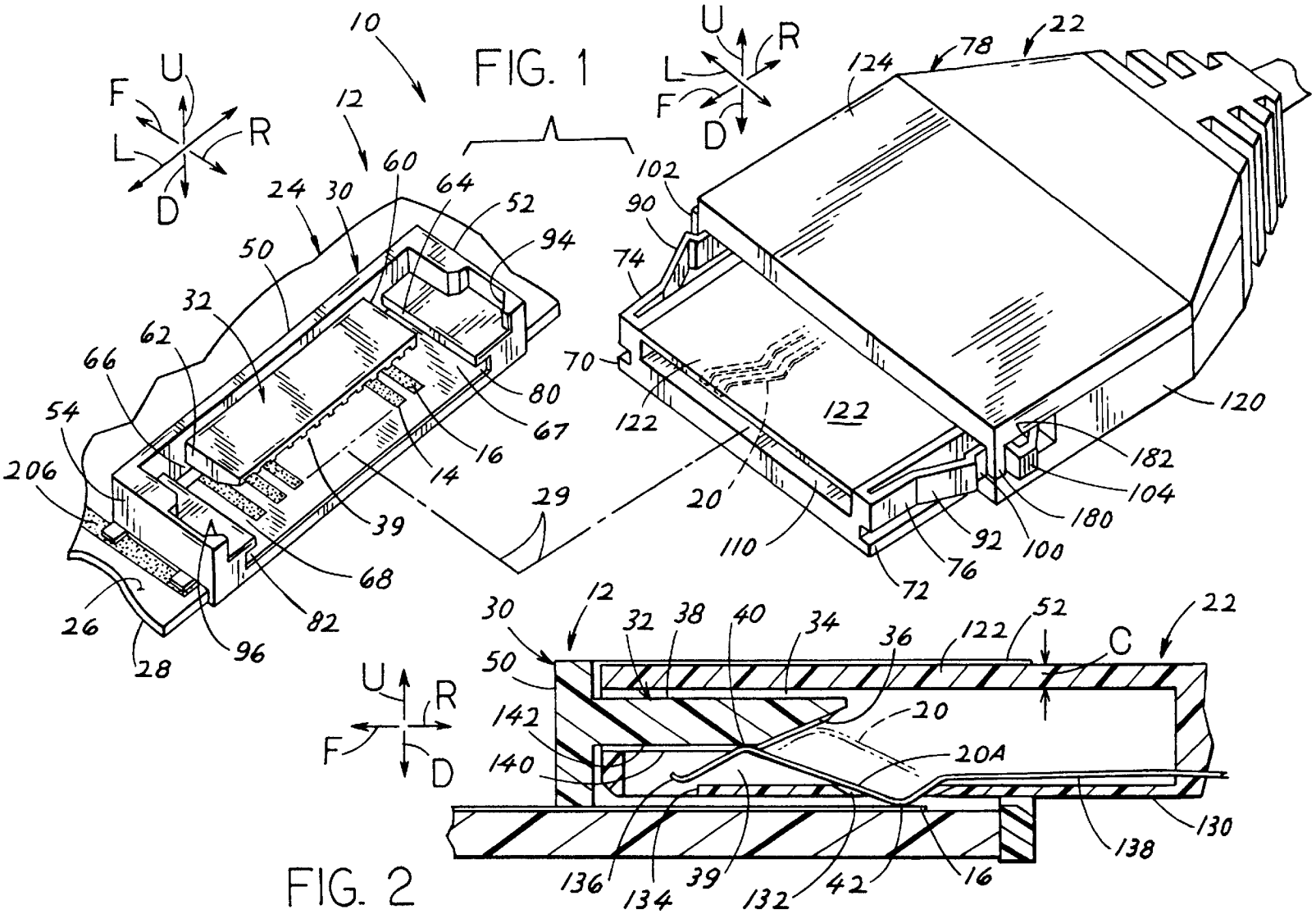
FIG. 1 is an exploded isometric simplified view showing a receptacle connector and a plug connector unmated from each other.
FIG. 2 is a simplified sectional side view of the receptacle connector and a portion of the plug connector of FIG. 1, shown fully mated.

FIG. 1 illustrates a portion of a cellular telephone 10 which has a receptacle connector 12 with a row 14 of terminals 16 for mating with contacts 20 of a plug connector 22. The receptacle connector 12 includes a circuit board 24 with upper and lower faces 26, 28, with the terminals 16 being in the form of traces on the circuit board. The receptacle connector also includes a receptacle housing 30 that is mounted on the circuit board. One purpose of the housing is to accurately align the plug contacts 20 with the receptacle connector traces 16 as they move together along axis 29. Another purpose is to latch the plug and receptacle connectors together when they have been mated, to prevent accidental pullout of the plug connector. For this system, the plug contacts 20 must be downwardly depressed to assure good contact with the traces 16, and the receptacle housing has a cam wall 32 for the purpose of downwardly depressing the contacts.

FIG. 2 shows the two connectors 12, 22 in their fully mated positions.

The cam wall 32 has a rear portion 34 with an inclined lower surface 36 that extends at a downward-forward incline, and has a front portion 38 with a substantially horizontal lower surface. As the plug 22 is moved forwardly F, the contacts, which are initially in the position 20, move into a space 39 under the cam wall and are deflected to the position 20A. Each contact has an upper cam-follower location 40 which moves along the inclined surface 36, to downwardly depress the contacts so a lower trace-engaging location 42 on each contact engages a corresponding trace 16.

FIG. 1 shows that the receptacle housing 30 has a front wall 50 and laterally (L) opposite side walls 52, 54, with the receptacle housing mounted on the circuit board substantially at these walls. A most obvious construction of the connector would be to have the cam wall 32 extend laterally between the opposite side walls 52, 54. However, applicant terminates the laterally opposite sides 60, 62 of the cam wall so there is a side space 64, 66 between each lateral side of the cam wall and the corresponding side wall of the receptacle housing. Since the row 14 of traces ends a distance short of the side walls 52, applicant uses the side spaces 64, 66 and side space areas 67, 68 (FIG. 11) that include the side spaces and areas under them and areas rearward thereof for other functions that are desirable for the connector.

One of the functions of the connectors is to precisely align the plug contacts 20 with the traces 16. Applicant provides the plug housing with a pair of aligners 70, 72 at the laterally opposite sides 74, 76 of the plug connector housing 78. Applicant forms the receptacle housing with a pair of aligner slots 80, 82 that closely receive the aligners 70, 72 on the plug. This assures that as the plug approaches the receptacle, it is stopped unless the aligners fit into the aligner slots, with such fitting assuring proper orientation and precise alignment of the plug contacts 20 with the traces 16. The aligner slots 80, 82 open in a rearward direction R and open laterally towards each other. The aligner slots accurately position the plug in a horizontal lateral direction L and in vertical directions U, D. The slots 80, 82 lie in the side space areas 67, 68.

The plug connector has a pair of latches 90, 92 that engage strikes 94, 96 formed at the opposite side walls 52, 54 of the receptacle housing. Each latch such as 92 is in the form of a bar which is bent (it is molded in a bent configuration) to form a largely rearwardly-facing shoulder 100 that engages largely forwardly-facing shoulders at the strikes. The bar-like latches can be deflected towards each other by pressing a pair of handles 102, 104 together, to move the shoulders 100 out of line with the strikes. When the connectors mate, the latches 90, 92 move into side space areas and specifically into the side spaces 64, 66 between the ends of the cam wall and the side walls of the receptacle housing. Thus, the use of a laterally short cam wall 32, that is mounted only at its front end to the rest of the receptacle housing, provides space for the functions of alignment and latching. In addition, the unmounted sides of the cam wall enable it to enter a forwardly-opening aperture or opening 110 at the front of the plug connector.

The plug connector housing 78 includes a bottom wall 120 with front and rear portions, and includes front and rear top walls 122, 124, each formed by a corresponding member. As shown in FIG. 2, the front top wall 122 is thin and lies closely (within 1 mm) above the cam wall 32. Preferably, the top wall 122 does not lie any higher than the upper ends of the receptacle housing side walls such as 52. The bottom wall front portion 130 has vertical openings 132 for passing the contact trace-engaging locations 42. The trace-engaging locations have a convex surface that faces downwardly, while the cam-follower locations 40 have convex locations that face upwardly. Except for the vertical openings 132 and additional openings 134 for possible reception of the extreme front ends 136 of the contacts, the bottom wall forward portion 130 is closed to protect the front portions 138 of the contacts (which are the portions that are free to deflect).

Figure 9:
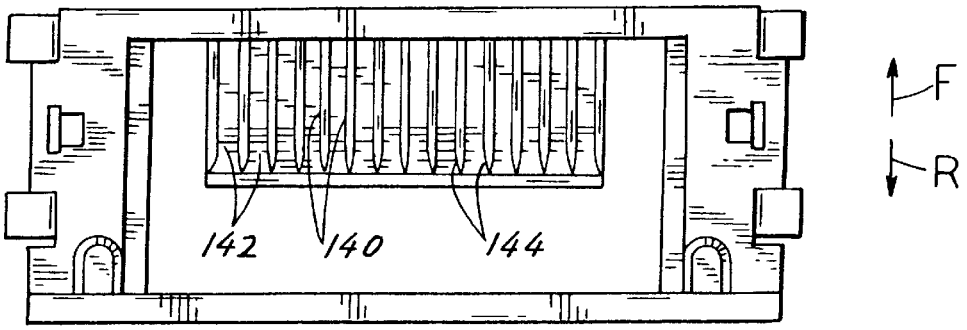
FIG. 9 is a bottom view of the receptacle connector housing of FIG. 7.

The cam wall 32 has a row of laterally spaced separators 140, and has strip-shaped cam surfaces 142 between the separators. The separators assure accurate alignment of the contacts with the circuit board traces, in addition to preventing the free forward portions of the contacts from touching one another even if they are slightly out of line. FIG. 9 shows that each separator has a tapered rear end 144. The tapering is provided to slightly deflect a contact that is not in its precise position. FIG. 11 is a front elevation view showing the separators 140. As shown in FIG. 13, if the contact is positioned with its cam-follower location at 40A so it is slightly laterally offset from its desired position, the tapered rear ends 144 will deflect it into an aligned position at 40 as the two connectors mate.

Figure 3:
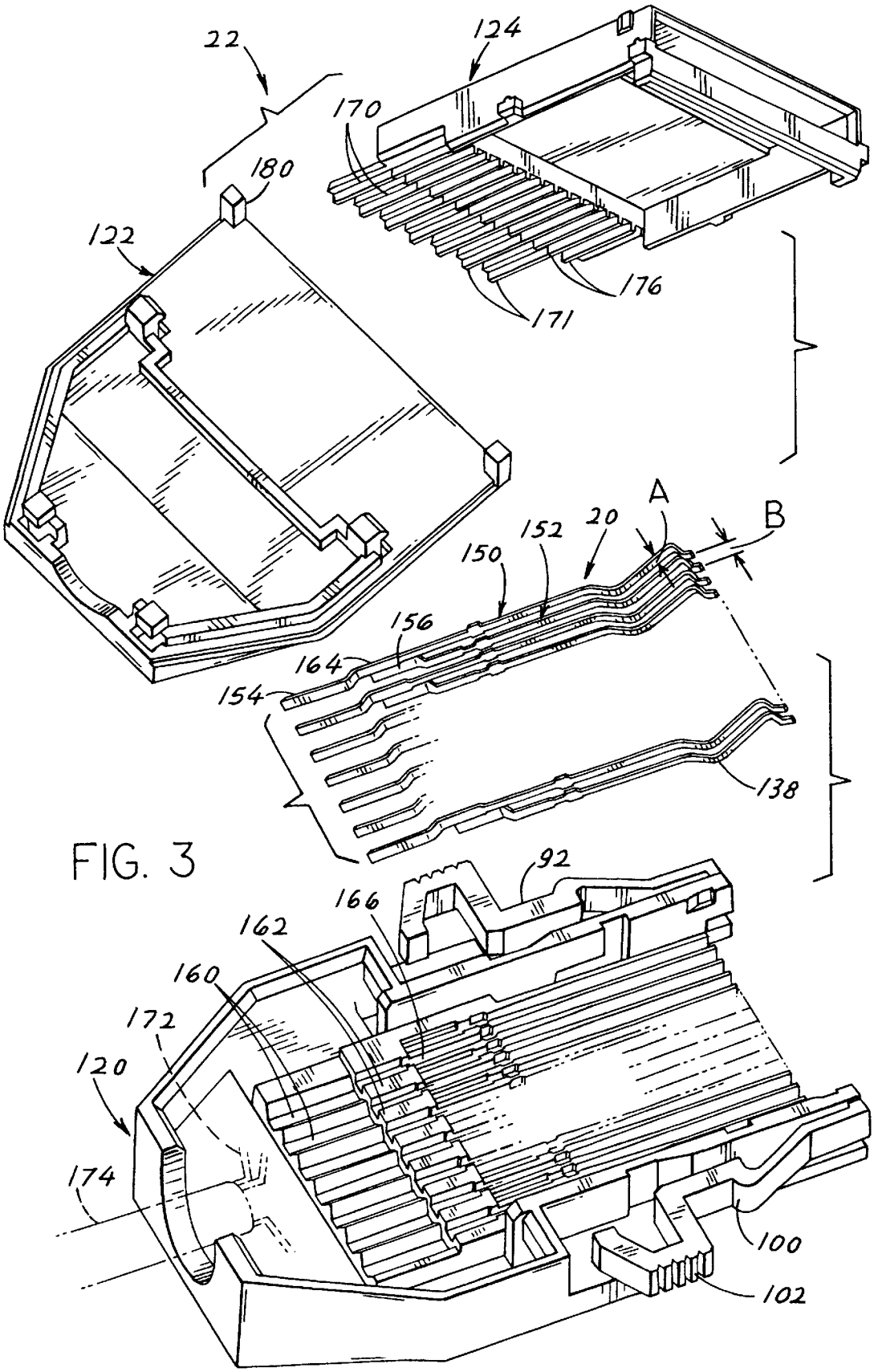
FIG. 3 is an exploded isometric view showing the parts of the plug connector of FIG. 1.

FIG. 3 shows the different parts of the plug connector 22, including the lower or bottom wall 120, a row of the strip-shaped plug contacts 20, the front top wall member 122 and the rear top wall member 124. The plug contacts 20 are arranged in two groups 150, 152, whose front portions 138 lie in a common row, but whose rear portions are different. The rear portions 154 of the first group 150 extend rearward of the rear portions 156 of the second group. The rear portions 154 of the first group are placed in rearward groove portions 160 of the lower wall. The rearward portions 156 of the second group are placed on platforms 162 which lie at a greater height than the bottoms of the grooves 160 where the first rear portions lie. The first group of contacts 150 have middle contact parts 164 that lie in middle groove portions 166. The middle contact portions 164 are held down in the middle groove portions 166 by bars 170 of the top wall forward member 124.

The bars 170 have free rearward ends 171. The bars not only hold down the first group middle portions 164, but also separate the second group rear portions 164 that lie on the platforms 162. The top wall forward member also has thin projections 176 that hold down locations of all contacts in grooves The contact rear portions 154, 164 are open in upward and rearward directions, so that wires 172 of a cable 174 can be routed and soldered to the corresponding contact rear portions.

The plug connector is assembled by first laying the contacts 20 in the grooves of the lower wall 120. Then the top wall member 124 is laid over the top front portion of the lower wall, over the contacts, in a position slightly forward of its final position and the member 124 is slid backward and automatically latched in place. After wires are soldered to the contact rear portions the rear top wall member 122 is moved down into position on the lower wall member by pivoting the member 122 down until it snaps in place. The contacts are not held in an interference fit, which avoids destroying such fit when the contacts are soldered to the wires.

It can be seen that the rear top wall member 122 has a pair of barriers 180 at its opposite sides. In the assembled plug connector shown in FIG. 1, the barriers 180 lie immediately forward of the handles 102, 104 of the latches. The barriers 180 help protect the latches from damage in the event that a person should project a pencil or other pointed instrument into the hollow area 182 and push the handle forwardly, which might break the latch.

Figure 7:
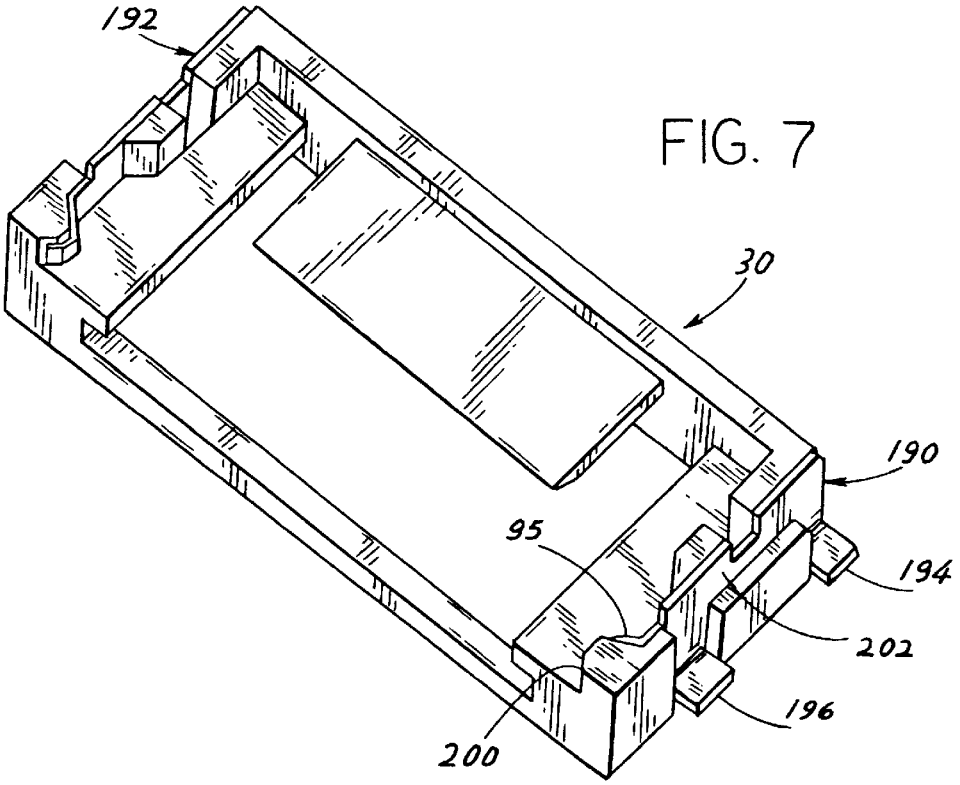
FIG. 7 is an isometric view of the receptacle connector housing of the receptacle connector of FIG. 1.
Figure 8:
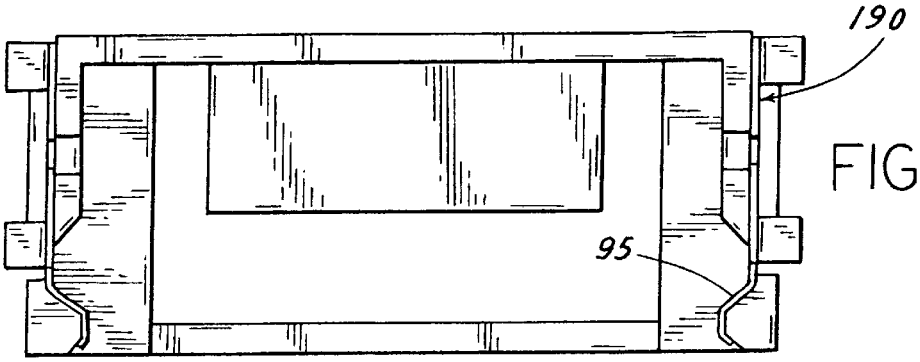
FIG. 8 is a plan view of the receptacle connector housing of FIG. 7.
Figure 15:
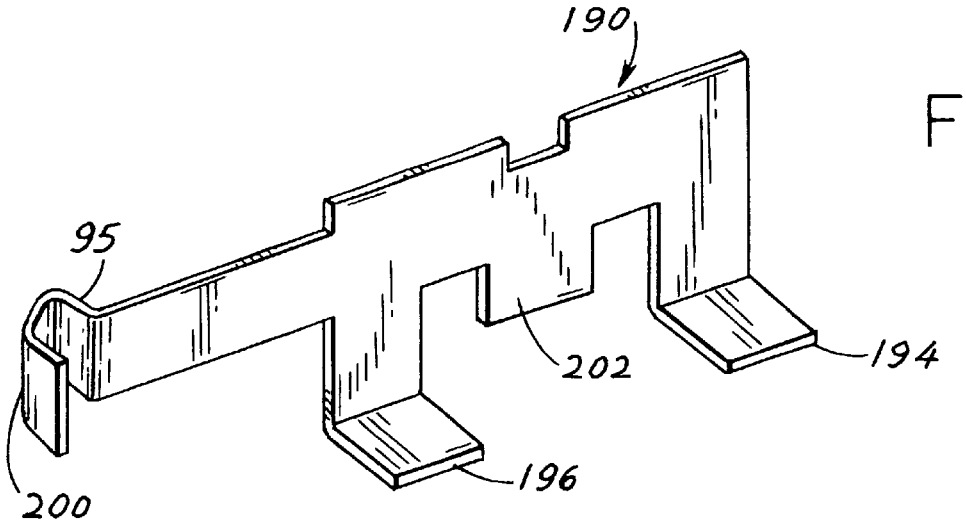
FIG. 15 is an isometric view of a clip of the receptacle connector.
Figure 16:
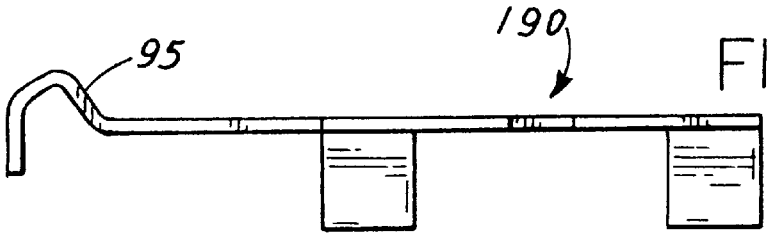
FIG. 16 is a plan view of the clip of FIG. 15.
Figure 17:
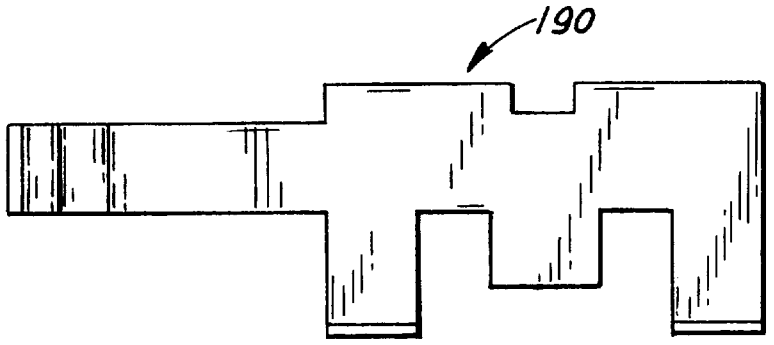
FIG. 17 is a side elevation view of the clip of FIG. 15.

FIG. 7 shows details of the receptacle connector housing 30. Most of it is formed of a polymer by injection molding. Applicant provides a pair of sheet metal clips 190, 192 at the opposite side walls, with horizontal lower pads 194, 196 for solder connection to traces on the circuit board. Each clip such as 190 has a strike portion 200 that forms the largely forwardly-facing shoulder 95 that engages the plug latch. Each clip also has a mount portion 202 that mounts to the receptacle connector housing 30. The shape of clip 190 is shown in FIGS. 15–17, while the other clip 192 is a mirror image of clip 190.

The provision of a sheet metal clip provides a metal strike, which can have a longer life than the polymer of the injection molded housing 30 (except where the housing is cast metal). Steel or a copper alloy of the clip has a Young's modulus of elasticity which is more than ten times that of average engineering plastics. The clip also enables the use of a metal (electrically conductive) latch instead of the insulative plastic latches shown, on the plug, to provide an electrical connection between the mating connectors. This is especially useful where a plug is used for recharging batteries on a portable phone that includes the receptacle. Such connections also can enable maintaining surfaces on both connectors at a constant ground potential to minimize pickup and radiation of high frequency signals. FIG. 1 shows solder pads soldered to a grounded (constant voltage) circuit board trace 206.

FIGS. 18–21 illustrate another receptacle connector 210 which is similar to that of FIGS. 1–17, but that includes a DC jack socket 212 with inner and outer jack terminals 214, 216. The inner terminal 214 is formed by a pin 220 mounted on a plastic molded housing 222 and having a tail 224 with a solder pad for soldering to a signal trace 226 on a circuit board 228. The outer terminal 216 is part of a clip 230. The clip includes a mount part 232 trapped in the plastic housing and a pair of ground solder pads 234, 236. The solder pads 234, 236 are designed for soldering to a grounded (i.e. constant voltage) trace 240 on the circuit board, to ground the outer terminal and hold down the connector to the circuit board.

In a connector system that applicant has designed, each of the contacts had a lateral width A (FIG. 3), at its front end, of 0.41 mm, with the contacts having a center-to-center spacing or pitch (B, FIG. 4) of 1.0 mm. The plug connector had an overall lateral width of 25.9 mm, except for the protruding latch handles, and an overall length in the forward and rearward directions of 36.1 mm. The front portion of the top wall 122 had a thickness C (FIG. 2) of 0.48 mm, while the cam wall 32 lay about 0.50 mm below the top of the front wall 30.

While terms such as "top", "bottom", etc have been used to aid in describing the invention as illustrated, it should be understood that the connector system can be used in any orientation with respect to the Earth.

Thus, the invention provides a connector system which effectively uses a small available space to provide the several functions that are required in such a system. The cam wall of the receptacle housing extends rearwardly from a front wall, with a side space between the cam wall and each side wall. The side space and the areas under and forward of them can be used for receiving aligners that align the plug with the receptacle and for receiving latches that latch the plug to the receptacle. The plug housing has a forwardly-opening opening that receives at least the rear portion of the cam wall, with the plug housing having a thin top wall that lies over the cam wall. The cam wall has an inclined surface at its rear portion, with barriers that bring a slightly misaligned contact into position, with the rear ends of the barriers being tapered to aid in this. While the plug housing top wall provides a shield above the contacts, the plug housing has a bottom wall that protects the area under the contacts, but with openings for downwardly passing terminal-engaging locations on the contacts. The receptacle housing has aligner slots that closely receive aligners on opposite sides of the plug housing, in spaces beyond and below the sides of a cam wall. The contacts are arranged in two groups that alternate along a lateral direction. A first group has rear portions that lie in slots in the bottom wall, while the second group has rearward portions that lie more forward and that lie on platforms on the bottom wall. The top wall has bars that lie between the rear portions of the second group and directly over middle portions of the first group.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector system that includes plug and receptacle connectors, where said receptacle connector includes a circuit board having an upper face with a laterally-extending row of conductive traces thereon and a receptacle housing mounted on said board and having a cam wall lying above said traces and forming a contact-receiving space between said cam wall and said conductive traces, and where said plug connector includes a plug housing and a plurality of plug contacts mounted thereon with each plug contact having a front portion with an upper cam-follower location and a lower trace-engaging location for respective depression by said cam wall and contact with one of said traces, wherein:

said receptacle housing has a front wall and laterally opposite side walls, and said cam wall has a front end mounted on said front wall with said cam wall being cantilevered in rearward extension from said front wall and with said cam wall having laterally opposite sides, with a side space between each of said cam wall sides and corresponding ones of side walls and with a side space area under and rearward and within each side space, with said housing forming a strike in each of said side space areas, and with said plug having laterally opposite plug sides and a latch at each of said plug sides which is constructed to enter one of said side space areas and engage a corresponding one of said strikes.

2. The system described in claim 1 wherein:

said plug housing has a top wall that lies over said plug contact front portions and that is positioned to slide to a position immediately over said cam wall when said contact upper cam-follower locations are depressed by said cam wall.

3. The system described in claim 1 wherein:

said contacts each have middle portions that are substantially fixed against vertical and lateral movement, and said contact front portions are free to deflect downwardly;

said plug housing has a bottom wall portion that lies below said contact front portions, with most of said bottom wall portion being closed but with said bottom wall portion having vertical openings lying immediately below said lower trace-engaging locations.

4. The system described in claim 1 wherein:

said plug housing has an aligner at each laterally opposite side thereof;

said receptacle housing has walls forming aligner slots at laterally opposite sides thereof, with each aligner slot open rearwardly and also laterally toward the other aligner slot, and with each aligner slot lying in one of said side space areas;

said walls forming said aligner slots having top, bottom and side walls and constructed to closely receive said aligners to precisely position said plug housing in lateral and vertical directions, with said top walls of said aligner slots lying below the level of said cam wall.

5. The system described in claim 1 wherein:

said cam wall has a lower surface with a plurality of downwardly-extending separators thereon that are laterally spaced and that each extends in a rearward direction from a front end of said cam wall, and with a plurality of contact-engaging strip-shaped camming surfaces lying between upper ends of said separators and positioned to engage said cam-follower locations on said contacts, with said contact front ends being strip-shaped with its least dimension generally being vertical and having upper and lower contact surfaces and with said upper contact surfaces positioned to engage said camming surfaces.

6. The system described in claim 5 wherein:

said separators have tapered rear ends that are progressively narrower in a lateral direction at progressively more rearward locations, whereby to laterally deflect a contact cam-follower location that is laterally displaced from its intended position.

7. The system described in claim 1 wherein:

said plug housing has opposite side walls, with each latch being in the form of a bar extending primarily rearwardly from a front end of one of said housing side walls, with said bars having rear ends forming handles and middles forming largely rearwardly-facing shoulders and with said bars being resiliently deflectable toward each other by pressing said handles closer together;

each of said handles has a front surface;

said plug housing includes barriers each lying immediately in front of the front surface of one of said handles, to prevent forward deflection of the handle.

8. The system described in claim 1 wherein:

said plug housing has a lower wall with middle groove portions for holding said plug contacts, with said lower walls having a rear portion with rear groove portions and with platforms lying between said rear groove portions, and with said rear groove portions extending rearward of said platforms;

said plug contacts have front and middle portions that all lie at the same height and have rear portions, with a first group of said contact rear portions extending along said rear groove portions and having rear walls lying rearward of the rear ends of a second group of plug contacts, and with said second group of plug contacts having rear ends lying on said platforms.

9. The system described in claim 8 wherein:

said plug housing has a top wall member with bars that lie on said first group of contacts at locations between said platforms.

10. A connector system that includes plug and receptacle members, wherein:

said plug connector includes a plug housing and a plurality of plug contacts mounted in said plug housing, with each plug contact having a free forward portion that includes an upper cam-follower location and a lower trace-engaging location;

said plug housing having upper and lower front wall portions lying respectively above and below the levels of said contact front portions, with said lower front wall portion having an open area lying under at least said trace-engaging locations, and said plug housing having a forwardly-opening end with an opening that is aligned with said upper trace-engaging locations;

said receptacle connector includes a cam wall having an inclined surface portion that extends at a downward-forward incline, with said cam wall being of a size to pass rearwardly through said opening in said front end of said plug housing and with said inclined surface portion extending down far enough to deflect said cam-follower locations so said contact lower trace-engaging locations pass down completely through and below said open area of said lower wall portion.

11. The connector system described in claim 10 wherein:

said lower wall portion has a row of laterally-spaced slots that each lies under the trace-engaging location of one of said contacts, and has closed lower wall locations lying both forward and rearward of each slot.

12. A plug connector comprising:

a plug housing with front and rear portions and with upper and lower walls, said lower wall having a laterally-extending row of middle groove portions for holding plug contacts, and said lower wall having a rear portion with rear groove portions and with platforms lying laterally between pairs of said rear groove portions, wherein said rear groove portions extend rearward of said platforms;

a plurality of plug contacts that include first and second groups of contacts that alternate laterally and that have front portions that all lie at the same height, and that have rear portions, with said first group of said contact rear portions lying within said rear groove portions and having rear ends lying rearward of the rear ends of said second group of plug contacts, with rear portions of said second group of plug contacts having rear ends lying on said platforms.

13. The system described in claim 12 wherein:

said plug housing has a top front wall member with rearwardly-extending bars that lie on said first group of contacts at locations between said platforms, with the rear ends of said bars being free and leaving spaces between them through which wires can extend that are soldered to said rear ends of said second groups of contacts.

14. A receptacle housing which is designed to mount on a circuit board or the like that has a lateral row of terminals to form a receptacle connector, and to receive a plug connector and deflect contacts of the plug connector against the traces as the plug connector is moved forwardly to mate with the receptacle connector, wherein:

said receptacle housing has a front wall and has laterally opposite sides, and said receptacle housing has a cam wall with a forward end mounted on said front wall and with said cam wall cantilevered and projecting rearwardly therefrom, with said cam wall having a rearward portion with an inclined lower surface for downwardly deflecting the plug contacts;

said cam wall rearward portion is free of connection to the rest of said receptacle housing except through said cam wall forward portion, to thereby enable said cam wall forward portion to enter an opening at the front of the plug connector.

15. The receptacle housing described in claim 14 wherein:

said rearward portion of said cam wall has a plurality of laterally-spaced separators depending from said inclined surface and dividing said inclined surface into a plurality of strips.

16. The receptacle housing described in claim 15 wherein:

said separators have tapered rear ends that are progressively narrower at progressively more rearward locations.

17. The receptacle housing described in claim 14 wherein:

said cam wall rearward portion has free laterally opposite sides; and including a circuit board with a grounded trace area;

a pair of sheet metal clips having mount portions mounted to said opposite sides of said receptacle housing at locations that are laterally beyond a corresponding one of said cam wall sides, with each clip having at least one solder pad soldered to said grounded trace area and a rearwardly-projecting arm forming one of said strikes.

18. The receptacle housing described in claim 14 including said plug connector and said plug contacts, wherein:

said plug connector has a forwardly-open opening and said cam wall rearward portion lies completely within said opening and downwardly deflects said plug contacts.

19. A method for mating plug and receptacle connectors while engaging front portions of plug contacts with terminals of the receptacle connector, comprising:

inserting a cam wall of the receptacle connector, where the cam wall has an inclined lower surface, into a forwardly-opening opening in the plug connector that is formed by top, bottom and side walls of a plug housing of the plug connector, so the cam wall lies between the plug housing top wall and cam-follower locations on the plug contact front portions and depresses them and to depress trace-engaging locations on the plug contact front portions down through an open area in the plug housing lower wall and against the terminals.

* * * * *